United States Patent [19]

Tucky

[11] 4,042,159

[45] Aug. 16, 1977

[54] TOILET ROLL TISSUE DISPENSER

[75] Inventor: Jane M. Tucky, Corona, Calif.

[73] Assignee: Ben E. Lofstedt, Buena Park, Calif.

[21] Appl. No.: 600,611

[22] Filed: July 31, 1975

[51] Int. Cl.[2] ..... B26F 3/02

[52] U.S. Cl. ..... 225/15; 225/23; 225/90; 225/77

[58] Field of Search ..... 225/77, 79, 80, 88, 225/82-85, 15, 23, 90

[56] References Cited

U.S. PATENT DOCUMENTS

| | | | |
|---|---|---|---|
| 681,745 | 9/1901 | Seawright | 225/85 X |
| 2,032,643 | 3/1936 | Westbo | 225/90 X |
| 2,251,942 | 8/1941 | Kimball | 225/77 X |
| 2,826,374 | 3/1958 | Kresser | 225/88 X |
| 2,973,891 | 3/1961 | Scheuer et al. | 225/82 X |
| 3,971,280 | 7/1976 | Imka | 225/15 X |

*Primary Examiner*—Robert B. Reeves
*Assistant Examiner*—Norman L. Stack, Jr.
*Attorney, Agent, or Firm*—Ben E. Lofstedt

[57] ABSTRACT

A dispenser for a toilet tissue roll for use with a toilet tissue roll holder wherein the roll is rotatably mounted on a bar forming a part of the holder, including a frame secured to the holder, a roller mounted to the frame over which the toilet tissue roll end is drawn, and a toilet tissue tear structure mounted to the frame and arranged below the top of the roller and formed by a body having an aperture therein for passing the toilet tissue end therethrough and further havng a blade-like edge adjacent the aperture through which the tissue exits, whereby when the roller means is manually rotated downwardly the end is urged over the roller means and through the aperture until the desired length of toilet tissue is passed through the body and thereafterwards the toilet tissue is manually gripped and urged upwardly to bring the toilet tissue into intimate abuttment with the blade-like edge to stress the tissue until separation thereof occurs.

4 Claims, 2 Drawing Figures

TOILET ROLL TISSUE DISPENSER

BACKGROUND OF THE INVENTION

1. Field of the Invention

The present invention lies within the field of toilet tissue roll dispensers, and more particularly, dispensers which are employed by handicapped persons.

2. Description of the Prior Art

The prior art is replete with various and diverse dispensers and holders for toilet tissue rolls having a wide range of physical shapes and operating characteristics.

However, at the present time, the typical toilet tissue roll dispenser consists of a U-shaped frame and a bar mounted therein whereon the toilet tissue roll is rotatably mounted. The rear portion of the frame usually has a number of holes therethrough whereby threaded fasteners are passed to secure the frame to a vertical mounting wall. When the frame is mounted in this fashion, the balance of the frame projects forwardly from the wall to which the frame is secured forming a pair of spaced-apart fingers. Disposed between the ends of the projecting fingers of the frame is a bar, generally cylindrical in form. The central open portion of the toilet tissue roll is passed over the bar and thereafterwards the bar is mounted to the frame by capturing the ends of the bar between the ends of the fingers, thereby securing the toilet tissue roll, in rotatable fashion, to the toilet tissue mounting frame.

In use, the toilet tissue roll is manually engaged and urged to rotate about the cylindrical bar. Initially, the user must attempt to locate the free end of the toilet tissue disposed on the outer surface of the tissue roll. Oftentimes, the process of locating the end of the roll is difficult due to the relative thinness of the tissue paper and its semi-transparent visual appearance. In addition, the nature of the tissue paper results in a clinging quality whereby the end of the roll tends to adhere to the body of the tissue roll making separation of the end of the tissue roll from the body thereof by rotating the roll manually, difficult, if not, in many instances, truly impossible.

As a result of these characteristics, the user is oftentimes forced to take steps to locate and free the end of the toilet tissue roll at a time when the urgency of the user's situation is painfully apparent, and the befuddlement thereby occasioned is frought with untimely frustration.

The resulting frustrations are significantly magnified when the situation is applied to those individuals who are in some way handicapped, and especially so if these handicaps include visual impairments.

According to recent statistics, there are a half a million individuals in the United States of America who are considered to be legally blind, with an estimated forty-four thousand new cases occurring each year. The term "legally blind" is frequently defined as having ten (10%) percent or less vision in the better eye after maximum correction. This figure is not totally representative of all those with visual impairments, which is estimated to be much greater than a half a million persons. Although the blind can be self-sufficient in various aspects of daily living, there are many areas which require special attention and improved techniques.

In addition to the blind, those individuals stricken with arthritis constitute another portion of the primary market for which special attention must be given. Currently, twenty million persons in the United States of America have arthritis, of which rheumatoid arthritis accounts for five million. Each year two hundred and fifty thousand new victims are disabled by this condition. One out of every four households has a member with arthritis. Twice as many women as men tend to be arthritis victims.

Because the disease is characterized by inflammation and swelling of the joints, those afflicted have difficulty in accomplishing tasks in their daily lives which are necessary for survival. Even the simplest things are trying for many with arthritis.

The two conditions which create significant handicaps and substantial problems in the use of the typical toilet tissue roll dispenser hereinbefore described constitute significant factors which motivated the creation of the instant invention hereinafterwards described.

SUMMARY OF THE INVENTION AND OBJECTS

The present invention is generally described as a toilet tissue roll dispenser, adapted for use in conjunction with a toilet tissue roll holder of the type primarily characterized as having a U-shaped frame adapted to be secured to a vertical wall with a bar removably detachable from the frame and whereon the toilet tissue roll is rotatably mounted, is disclosed herein.

More particularly, there is disclosed herein a roll toilet tissue dispenser for use with the above-identified and described holder for promoting ease of dispensing the toilet tissue by ensuring the clean, uniform separation of the end sheet of the roll of toilet tissue from the body of the toilet tissue roll and by presenting the end sheet in readiness to the user thereof, including a frame secured to the holder, a roller mounted to the frame over which the toilet tissue roll end is drawn, and a toilet tissue tear structure mounted to the frame and arranged below the top of the roller and formed by a body having an aperture therein for passing the toilet tissue end therethrough and further having a blade-like edge adjacent the aperture through which the tissue exits, whereby when the roller means is manually rotated downwardly the end is urged over the roller means and through the aperture until the desired length of toilet tissue is passed through the body and thereafterwards the toilet tissue is manually gripped and urged upwardly to bring the toilet tissue into intimate abuttment with the blade-like edge to stress the tissue until separation thereof occurs.

It is accordingly an object of the present invention to provide a roll toilet tissue dispenser which maintains separation between the outer free end of the toilet tissue roll and the body of the roll.

Another object of the present invention is to provide a roll toilet tissue dispenser which presents the end sheet of the toilet tissue roll in readiness for immediate use.

Another important object of the instant invention is to provide an improved toilet tissue dispensing means for handicapped persons.

A still further important and primary object of the instant invention is to significantly improve the means whereby toilet tissue separation is accomplished for use thereof.

Another important object of the instant invention is to provide a means whereby the toilet tissue paper can be engaged for dispensing in the improved toilet tissue dispenser as disclosed herein.

The subject manner which I regard as my invention is particularly pointed out and distinctly claimed in the concluding portion of this Specification. The invention itself, however, both as to its organization and method of operation, together with further objects and advantages thereof, may be better understood by reference to the following description taken in connection with the accompanying drawings:

DETAILED DESCRIPTION OF THE PREFERRED EMBODIMENT

Figure 2:
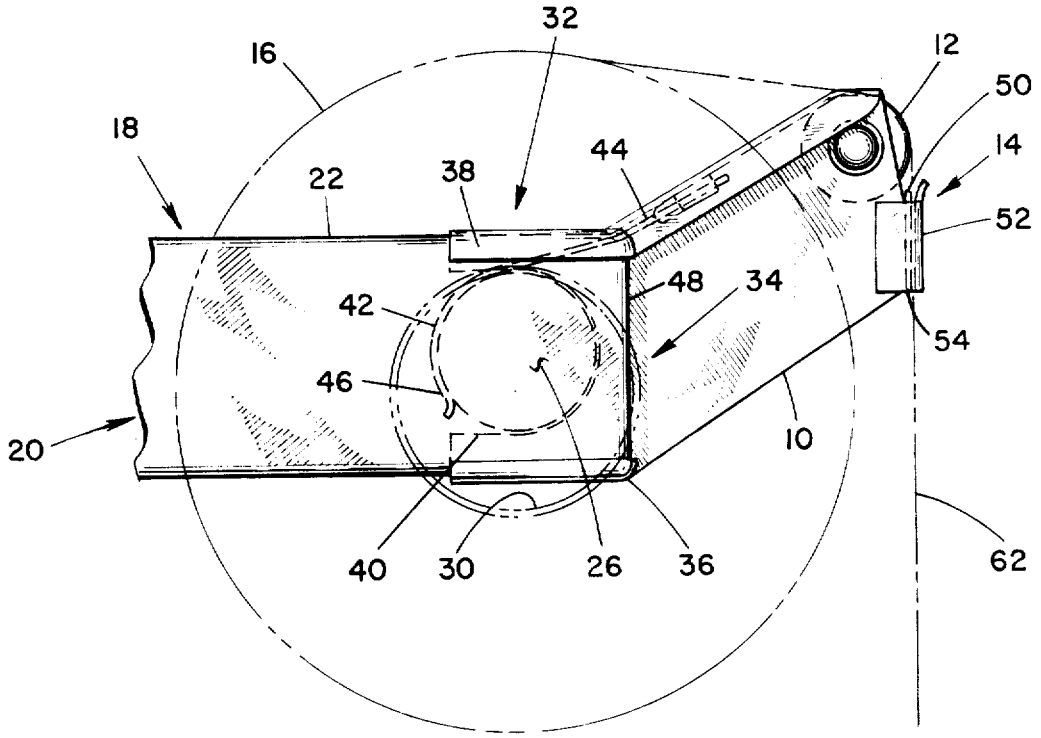
FIG. 2 is a side elevational view of FIG. 1 taken along Plane 2—2.
Figure 1:
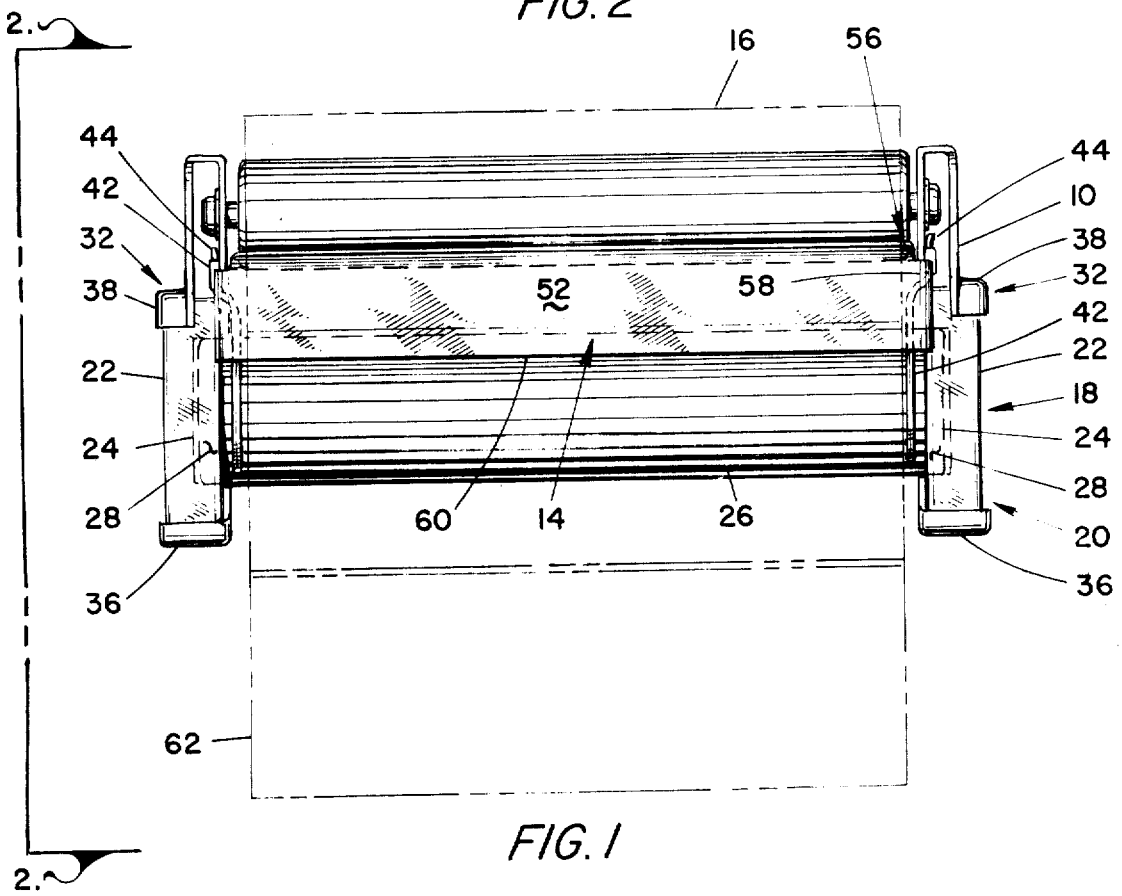
FIG. 1 is a front elevational view of the present invention shown attached to a toilet tissue roll holder.

Referring more particularly now to the drawings, there is shown an improved dispenser and tissue tearing mechanism for a toilet tissue roll which is mounted to and used in a holder for a toilet tissue roll. This device generally comprises a frame 10, a roller means 12, and a tear means, generally indicated at 14.

A toilet tissue roll is generally indicated at 16, and is shown supported in a typical toilet tissue roll holder, generally indicated at 18. The holder 18, in turn, is basically composed of two major sections: a frame member, generally indicated at 20, having a pair of forwardly-projecting fingers 22, with a pair of oppositely-disposed receptacles 24 on the inside faces of the fingers 22 and a bar 26 whose ends 28 are disposed within the receptacles 24 to provide support for the bar 26. The toilet tissue roll 16 is rotatably mounted on the bar 26 via its normal central, axially-disposed passageway 30.

The frame 10 is preferrably formed of sheet material and is fundamentally characterized at one end as a pair of coupling sections, generally indicated at 32, for securing the frame 10 to the holder 18 via the fingers 22, and at its forwardmost ends, generally indicated at 34, as a structure upon which the roller means 12 and the tear means 14 are mounted.

With specific reference now to the coupling sections 32 of the frame 10, the bottom of the coupling sections 32 each have an outwardly-projecting tab 36 and the top of each of the coupling sections 32 is characterized by a J-shaped channel 38 whose channel width is slightly larger than the width of the forwardmost ends of the fingers 22. Intermediate the bottom and top of each of the coupling sections 32 is a slot 40, the width of which is slightly larger than the diameter of the bar 26, and whose function and purpose will become more clearly apparent as the description of the preferred embodiment of the instant invention proceeds herein. A pair of retainer springs 42 are each secured at one end 44 to the channel 38. The opposite end 46 of each spring 42 is formed in arcuate fashion and is disposed across the entrance to the slots 40.

The specific use and function of the coupling sections 32 is to mate with the frame 10 of the present invention to the forwardmost projecting ends 48 of the fingers 22 of the toilet tissue holder 18 so that the frame 10 may be fully supported thereby. The coupling sections 32 are mated with the fingers 22 by sliding the channel 38 portions over the uppermost portions of the ends 48 of the fingers 22 and locating the tab 36 portions adjacent to the lowermost portions of the ends 48 of the fingers 22. Simultaneously therewith the retainer springs 42 are manually moved away from the entrance to the slots 40, the slots 40 are passed over the bar 26 thereby locating the bar 26 within the slots 40. The retainer springs 42 are then permitted to return to their former positions closing the entrance to the slots 40, thereby capturing the bar 26 within the pair of slots 40 and completing the final step necessary to securely mount the frame 10 to the pair of fingers 22 of the toilet tissue holder 18.

Turning now to the forwardmost end 34 of the frame 10, the roller means 12 is shown to be disposed intermediate the pair of forwardmost ends 34 and rotatably mounted at the opposite ends thereto. The tear means 14 comprises two blade-like members 50, 52 which are joined by a hinge 54 at one end so that the member 52 facing the outside forms a gate capable of being pivotably moved away from and towards the inner member 50 adjacently disposed to the toilet tissue roll 16. A frictional latch, generally indicated at 56, is formed by the unhinged end 58 of the outwardly-facing member 52 by curving the unhinged end 58 inwardly so that frictional interference is created between the unhinged end 58 and the frame 10 disposed immediately adjacent to the unhinged end 58 when the gate is closed. The lowermost portion of the member 52 forms a tissue-tearing edge 60.

OPERATION OF THE PREFERRED EMBODIMENT

Following the attachment of the frame 10 of the present invention to the toilet tissue roll holder 18 as previously described herein, the free end 62 of the toilet tissue roll 16 is initially drawn over the roller means 12 and through the space separating the blade-like members 50, 52.

To use the instant invention, the user merely manually urges the roller means 12 to rotate in a downward direction (clockwise) thereby causing the toilet tissue paper, which is now sandwiched inbetween the user's hand and the roller means 12 to unroll from the toilet tissue roll 16 and to move downwardly from the roller means 12 and between the members 50, 52.

When the desired length of toilet tissue is obtained, the toilet tissue free end 62 is gripped and pulled upwardly into intimate engagement with the tissue tear edge 60 of the member 52. When sufficient stress is placed upon the tissue engaged with the edge 60 by increasing the manually-applied tension thereto, the tissue paper will tear thereby separating the desired amount of toilet tissue for use.

As is clearly apparent from the above description of the operation of the present embodiment of the invention herein, the tissue paper end 62 is always separated from the tissue roll 16 and is presented to the user at all times by its position on the roller means 12 and also by its position below the tear means 14. Further, in using the tear means 14 to separate the tissue, the end 62 is not only separated in a uniform fashion, but remains separated from the toilet tissue roll 16. All of these features and advantages promote ease of operation by individuals with such handicaps as visual impairment and arthritic inflamations which impair physical movement and dexterity.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

For example, the gate which is formed by the members 50, 52 and the hinge 54 may be easily and conveniently changes to a single, cast structure with merely an aperture therethrough which is slightly wider than the width of the tissue paper being fed through it.

What I claim as my invention is:

1. An improved toilet tissue roll dispenser for use in conjunction with a toilet tissue roll dispenser wherein said toilet tissue roll is rotatably mounted, via the central passageway therethrough, on a bar secured to the arms of a U-shaped structure, comprising:

a. frame means having a pair of fingers with oppositely-disposed receptacles therein and a first cross-member having a blade-like edge across the bottom thereof joining said pair of fingers;

b. coupling means for securing said fingers of said frame means to said arms of said holder;

c. roller means disposed forwardly of said holder in spaced-apart, longitudinal relationship to said bar and above said first cross-member, said roller means having a pair of oppositely-disposed ends journaled for rotation with said receptacles of said frame means, whereinover said toilet tissue is drawn and thereafterwards is disposed in intimate relationship to said blade-like edge of said first cross-member of said frame means whereby when the desire length of toilet tissue is manually drawn from said toilet tissue roll, the toilet tissue is manually directed downwardly and rearwardly to be placed transversely across said blade-like edge of said first cross-member and severed thereacross and following said toilet tissue severance, the unsevered portion of said toilet tissue disposed between said roller means and said blade-like edge is directed by the co-action of said downward and rearward force and the roller means towards said first cross-member thereby ensuring presentation of the end of said toilet tissue roll for the next use and severance thereof, and wherein said first cross-member is formed of a flat sheet of material and said blade-like edge faces downwardly and further comprising, a second cross-member formed of a flat sheet of material complementary to said first cross-member and secured to said frame means in corresponding fashion to said first cross-member, said second cross-member being disposed in parallel, spaced-apart, face-to-face relationship to said first cross-member thereby forming a gap therebetween sufficient to permit said toilet tissue to pass freely therethrough whereby when the desired length of toilet tissue is drawn therethrough, the toilet tissue drawn therethrough may be manually directed upwardly to place the toilet tissue against the bottom edge of said second cross-member and thereafterwards, with further tension force manually impressed thereon in an upward fashion on said toilet tissue, said toilet tissue may be severed across said blade-like bottom edge.

2. The improved toilet tissue dispenser of claim 1, wherein said second cross-member is secured to said frame means by means of:

a. a hinge having a pair of elements pivotally movable with respect to each other, one element being fixedly secured to one end of said first cross-member and disposed forwardly thereof and the other of said hinge elements being fixedly secured to the complementary and adjacent end of said second hingedly movable with respect to said first cross-member so that the opposite end of said second cross-member so that the opposite end of said second cross-member may be movable towards and away from said first cross-member as desired; and b. a latching means operatively associated with the complementary unhinged ends of said first and second cross-members for removably latching said ends with respect to each other.

3. The improved toilet tissue dispenser of claim 1, wherein said frame means is formed of sheet material and said coupling means comprises:

a. frames means wherein the ends of said pair of fingers each have a slot therein for receiving said bar therein;

b. a first channel formed in each of said ends of said pair of fingers arranged along the top edge of said finger above said slot for slideably mating over the upper portion of said arms of said holder to form a cap therefor; and c. a second channel corresponding to said first channel and oppositely disposed thereto, said second channel being arranged along the bottom edge of said finger below said slot for slideably mating over the lower portion of said arms of said holder to form a cap therefor.

4. An improved toilet tissue roll dispenser for use in conjunction with a toilet tissue roll holder wherein said toilet tissue roll is rotatably mounted, via the central passageway therethrough, on a bar secured to the arms of a U-shaped structure, comprising:

a. frame means wherein the ends of said pair of fingers each have a slot therein for receiving said bar therein, and further including a first channel formed in each of said ends of said pair of fingers arranged along the top edge of said finger above said slot for slideably mating over the upper portion of said arms of said holder to form a cap therefor, and a second channel corresponding to said first channel and oppositely disposed thereto, said second channel being arranged along the bottom edge of said finger below said slot for slideably mating over the lower portion of said arms of said holder to form a cap therefor;

b. coupling means for securing said fingers of said frame means to said arms of said holder;

c. roller means disposed forwardly of said holder in spaced-apart, longitudinal relationship to said bar and above said first cross-member, said roller means having a pair of oppositely-disposed ends journaled for rotation within said receptacles of said frame means, whereinover said toilet tissue is drawn and thereafterwards is disposed in intimate relationship to said blade-like edge of said first cross-member of said frame means; and d. a pair of arcuate retainer springs, each having one end which is fixedly anchored respectively to said frame means and the other portion arranged to bridge the entrance to said slot, whereby when said bar is mated to said slot, said bar is captured therein by said spring bridging said slot entrance.

* * * * *